United States Patent [19]

Jonsson

[11] Patent Number: 4,805,405

[45] Date of Patent: Feb. 21, 1989

[54] POWER PLANT WITH COMBUSTION OF A FUEL IN A FLUIDIZED BED

[75] Inventor: Arne Jonsson, Finspong, Sweden

[73] Assignee: Asea Stal Ab, Finspong, Sweden

[21] Appl. No.: 65,475

[22] Filed: Jun. 23, 1987

[30] Foreign Application Priority Data

Jul. 3, 1986 [SE] Sweden ..... 86029592

[51] Int. Cl.[4] ..... F02C 3/26

[52] U.S. Cl. ..... 60/39.464; 110/266

[58] Field of Search ..... 60/39.12, 39.464; 110/244, 245, 263, 266; 122/4 D; 431/170

[56] References Cited

U.S. PATENT DOCUMENTS

| | | | |
|---|---|---|---|
| 2,812,592 | 11/1957 | Knibbs et al. . | |
| 4,287,838 | 9/1981 | Moynihan | 110/266 |
| 4,297,321 | 10/1981 | Beranek | 110/244 |
| 4,382,415 | 5/1983 | Korenberg . | |
| 4,474,119 | 10/1984 | Jones | 110/263 |
| 4,584,949 | 4/1986 | Branstrom | 60/39.464 |
| 4,655,147 | 4/1987 | Branstrom et al. | 60/39.464 |

FOREIGN PATENT DOCUMENTS

| | | |
|---|---|---|
| 0063173 | 10/1982 | European Pat. Off. . |
| 417636 | 3/1981 | Sweden . |
| 8303271 | 12/1984 | Sweden . |
| 739213 | 10/1955 | United Kingdom . |

*Primary Examiner*—Louis J. Casaregola

*Attorney, Agent, or Firm*—Pollock, Vande Sande & Priddy

[57] ABSTRACT

A power plant with combustion of a fuel in fluidized bed (21) of particulate material, usually contains a sulphur absorbent. A bottom (14) divides a bed vessel (12) into an upper combustion chamber (15) and a lower conical or pyramid-shaped ash discharge chamber (16) for discharging ashes and consumed bed material. The bottom (14) is formed with openings (22) through which material is able to pass. Cooling air is supplied to the lower part of the lower chamber (16). This chamber (16) is provided with grates (37, 38) with horizontal channels (46) for spreading cooling air from the central part of the chamber (16) to its outer parts. These grates (37, 38) may be formed of U-sections with their openings facing downwards. The channels (46) of a grate (37) may be connected to the combustion chamber (15) by vertical tubes (50).

6 Claims, 2 Drawing Sheets

POWER PLANT WITH COMBUSTION OF A FUEL IN A FLUIDIZED BED

TECHNICAL FIELD

The invention present relates to a power plant with combustion of a fuel in a fluidized bed of a particulate material. This material consists of or contains a sulphur absorbent, such as lime or dolomite, for binding sulphur in the fuel during the combustion. It is primarily intended for a PFBC plant, in which the combustion takes place at a pressure exceeding the atmospheric pressure and in which a bed vessel with a combustion chamber is surrounded by a pressure vessel with combustion air with a pressure amounting to about 2 MPa. The term "PFBC" is formed by the initial letters in the expression Pressureized Fluidized Bed Combustion.

BACKGROUND ART

The bed vessel consists of a container which is divided by a bottom into an upper combustion chamber with a fluidized bed and a lower ash discharge chamber for the discharge of ashes and consumed bed material. The bottom may consist of elongated, parallel air distribution chambers with nozzles for combustion air for fluidization of a bed of particulate bed material above the bottom and for combustion of a supplied fuel. The combustion chamber is supplied with combustion air from a compressor. Between the air distribution chambers there are openings through which ashes and bed material may pass from the combustion chamber to the ash chamber below the bed vessel bottom. The ashes and the bed material are cooled by air prior to being discharged via a sluice system.

The chamber for discharging ashes and bed material is usually shaped as a conical or pyramidal hopper with its downwardly-directed tip connected by a tube to the discharge device. In order for the cooling air to be utilized as efficiently as possible, it is introduced at the bottom into the ash discharge chamber and thus flows in the opposite direction to the material to be fed out. It has been found that the cooling air does not spread uniformly over the cross section when flowing upwards through the ash chamber. This means, that the cooling at the outer parts of the ash chamber is unsatisfactory and that the air speed may reach such a level in the central part of the ash chamber that the material in the ash chamber and between air distribution chambers is fluidized. This fluidization increases the heat transfer to the walls of the air distribution chambers and may result in such a heating as to jeopardize the strength. Furthermore, the concentration of the ash cooling air results in an undesired and uneven air distribution over the cross section of the combustion chamber, which may disturb the operation.

SUMMARY OF THE INVENTION

According to the invention, the spreading of the cooling air in the ash discharge chamber is improved by locating therein a grate having substantially horizontal air channels with an insignificant flow resistance. The grate may be constructed of open sections, for example U-sections, with the opening facing downwards so as to form channels free from material inside these sections. Grates may be located at two or more levels. Between these levels there may be arranged vertical pipe connections, through which cooling air may flow up from a channel in a lower grate to another channel in a grate located above it. Cooling air collected in channels in the central part of the space flows horizontally outwards and out into the material in the outer parts of the space. Furthermore, vertical pipe connections may be arranged between a grate layer and the combustion chamber. Pipes from a grate layer pass between the air distribution chambers, which form the bed bottom of the bed vessel. These pipes suitably terminate in a nozzle similar to the nozzles of the air distribution chambers and at the same level as these.

BRIEF DESCRIPTION OF THE DRAWING

The invention will be described in greater detail with reference to the accompanying drawings, wherein FIG. 1 schematically shows the invention present as applied to a PFBC plant.

DESCRIPTION OF THE PREFERRED EMBODIMENT

Figure 1:
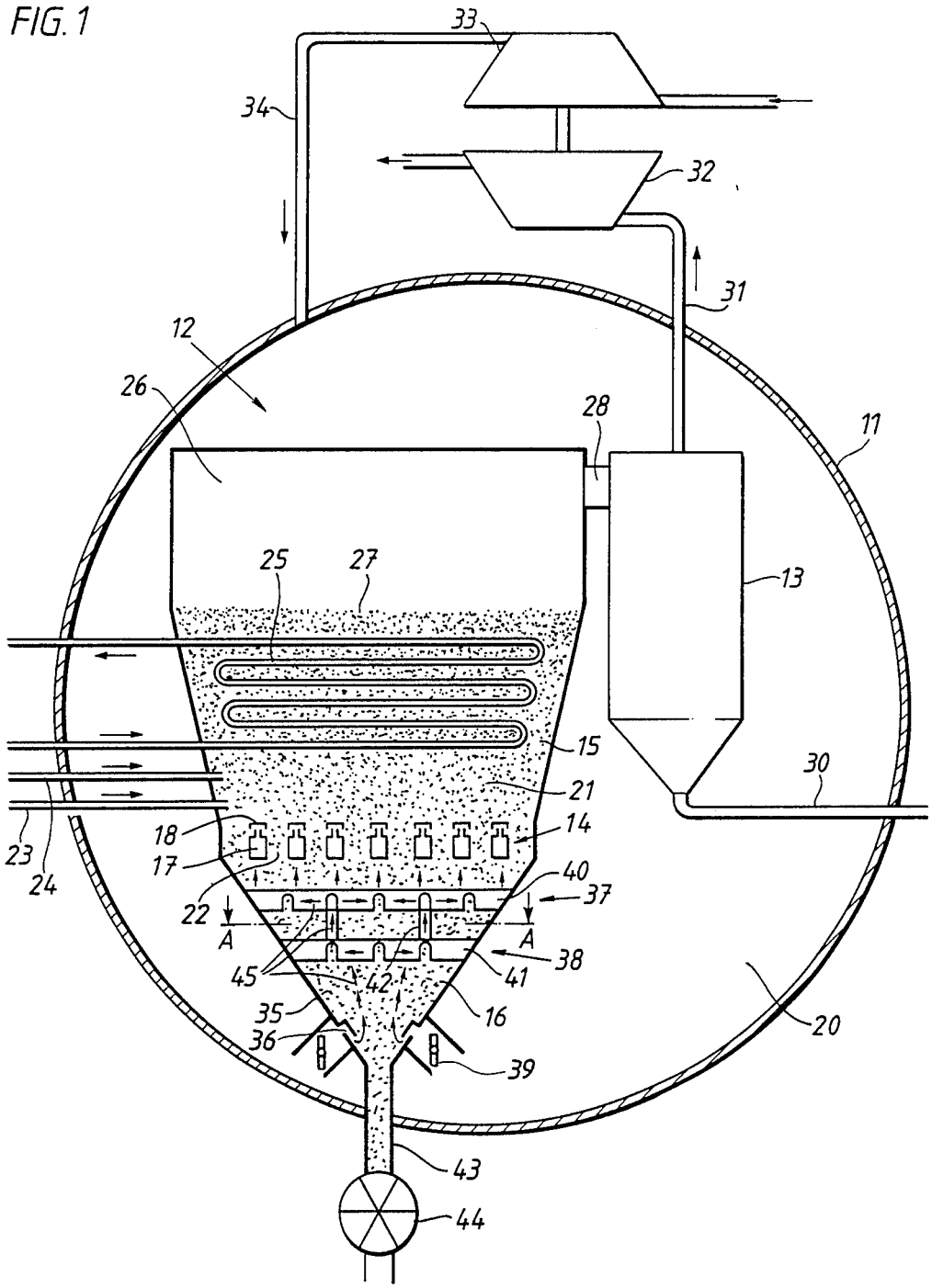

In the figures, 11 designates a pressure vessel, 12 a bed vessel and 13 a cleaner of cyclone type enclosed within the pressure vessel 11. Only one cyclone 13 is shown, but in reality there is a cleaning plant with a number of parallel groups of series-connected cyclones. The bed vessel 12 includes a bottom 14 which divides the bed vessel 12 into an upper combustion chamber 15 and a lower ash chamber 16. The bottom 14 consists of a number of parallel air distribution chambers 17 with nozzles 18. Through these chambers 17 the combustion chamber 15 is supplied with combustion air from the space 20 between the pressure vessel 11 and the bed vessel 12. This air fluidizes the particulate material which forms the bed 21 and burns fuel supplied to the bed 21. Between the air distribution chambers 17 there are openings 22 through which ashes and consumed bed material may pass to the chamber 16. Fuel and fresh bed material are supplied to the bed vessel 12 through conduits 23 and 24, respectively, from a storage (not shown). The combustion chamber 15 contains cooling tubes 25 for cooling the bed and generating steam to a steam turbine (not shown).

Combustion gases formed are accumulated in the freeboard 26 above the bed surface 27 and are lead through the conduit 28 to the cleaner 13 where dust is separated from the gases. The dust is discharged through the conduit 30 to a collection container (not shown). Cleaned gases are lead through the conduit 31 to a turbine 32. The turbine 32 drives a compressor 33 which, through the conduit 34, supplies the space 20 with combustion air.

Figure 4:
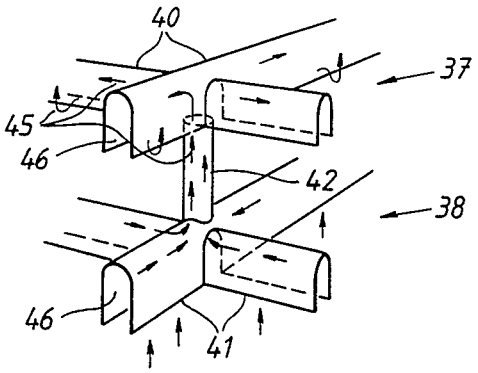
FIG. 4 shows a perspective view of grates with air channels.

In the lower conical part 35 of the bed vessel 12, which forms the ash chamber 16, there are openings 36 with regulating means 39 for the supply of cooling air from the space 20 to the chamber 16 for cooling of material present in the chamber 16. In the embodiment according to FIG. 1, the chamber 16 accomodates two layers of grates 37 and 38, which are built up of U-sections 40 and 41, respectively, with their openings directed downwards and forming horizontal channels 46 (see FIG. 4). The grate layers 37, 38 are interconnected by vertical tubes 42, which allow vertical transport of cooling gas between the layers. The conical part 35 of the bed vessel is connected to an outlet tube 43 having a sluice-type discharge device 44.

The cooling air supplied to the lower part of the conical ash chamber 16 encounters the downwardly-flowing bed material and the ashes and flows through the bottom 14 up into the combustion chamber 15, where it is utilized for the combustion.

Figure 3:
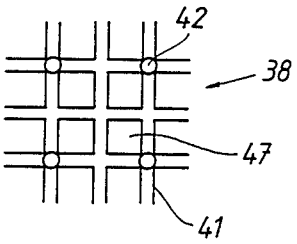
FIG. 3 shows a section through the ash discharge chamber according to A—A in FIG. 1.

The cooling air strives to take the shortest path up through the material in the centre of the chamber 16. There is a risk of an undesired fluidization of the material in the centre of the chamber 16. Furthermore, the material close to the wall of the conical part 35 will not be cooled. Since part of the cooling air is collected in the downwardly open U-sections 40, 41 of the grates 37, 38, where they may flow horizontally in the lateral direction in the formed material-free channels 46 with no significant flow resistance, a more uniform distribution of the cooling air flow over the entire cross section can be attained. The air in the channels 46 of the U-sections 40, 41 finds its way out into the material in the chambers 16 along the sections, as indicated by the arrows 45. As shown in FIG. 3, the grates 37, 38 have openings 47 through which ashes and bed material are able to pass.

Figure 2:
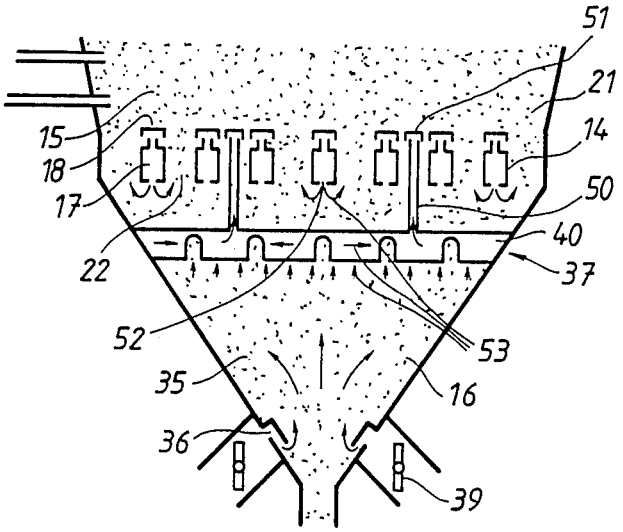
FIG. 2 shows the lower part of a bed vessel in an alternative embodiment.

In the embodiment according to FIG. 2, the chamber 16 is only provided with one grate 37 built up of sections 40. To these sections 40 there are connected vertical tubes 50, passing up between the air distribution chambers 17 and opening out with their nozzles 51 at the same level as the air nozzles 18. At the bottom of the air distribution chambers 17 there are outflow openings 52 for a minor part of the combustion air. The air flow is indicated by arrows 53. Since the flow resistance in the tubes 50 is smaller than the flow resistance in the material layer between the grate 37 and the bottom 14, the cooling air captured by the sections 40 will to a considerable extent flow to the combustion chamber 15 through the tubes 50. In this way, also in the case of a considerable flow of cooling air, it is possible to provide such a low flow within the layer between the grate 37 and the bottom 14 that the risk of fluidization in the layer and between the air distribution chambers 17 can be eliminated.

I claim:

1. A power plant with combustion of a fuel in a fluidized bed, comprising:

a bed vessel;

a bottom dividing said bed vessel into an upper combustion chamber and a lower ash discharge chamber;

a plurality of openings in said bottom for passing ashes and consumed bed material to said ash discharge chamber;

feed means for feeding bed material and fuel into the combustion chamber of said bed vessel;

a compressor for supplying said bed vessel with air for the fluidization and the combustion;

a discharge means for discharging ashes and consumed bed material from said ash discharge chamber;

means for introducing cooling air into material present in said ash discharge chamber for direct cooling of said material;

air collecting and distributing means provided across said ash discharge chamber above said means for introducing air, said collecting and distributing means including substantially horizontal members forming downwardly open channels for collecting upwardly flowing cooling air and distributing said collected air over the area of said ash discharge chamber, to provide substantially uniform cooling of said ash discharge chamber.

2. A power plant according to claim 1 wherein said downwardly open channels are formed with U-shaped cross-sections.

3. A power plant according to claim 2 wherein at least two layers of said downwardly open channels are located at different levels of said ash discharge chamber and are interconnected by vertical connecting pipes.

4. A power plant according to claim 2 further comprising vertical tubes connected to said open channels, said tubes opening out into said bottom of said combustion chamber at substantially the same level as air nozzles of said bottom.

5. A power plant according to claim 4, wherein said bottom is provided with air distribution chambers having air outflow openings or nozzles.

6. A power plant according to claim 2 or 3 wherein said downwardly open channels form a horizontal grate with openings for passage of said material.

* * * * *